US009159539B2

(12) United States Patent
Larson et al.

(10) Patent No.: US 9,159,539 B2
(45) Date of Patent: Oct. 13, 2015

(54) METHOD AND APPARATUS TO PROVIDE PARALLEL ACQUISITION OF MASS SPECTROMETRY/MASS SPECTROMETRY DATA

(71) Applicants: ULVAC-PHI, INCORPORATED, Kanagawa-Ken (JP); Ron M. Heeren, Weesp (NL)

(72) Inventors: Paul E. Larson, Bloomington, MN (US); John S. Hammond, Plymouth, MN (US); Gregory L. Fisher, Chaska, MN (US); Ron M. Heeren, Weesp (NL)

(73) Assignees: ULVAC-PHI, INCORPORATED, Kanagawa-Ken (JP); Ron M. Hereen, Weesp (NL)

( * ) Notice: Subject to any disclaimer, the term of this patent is extended or adjusted under 35 U.S.C. 154(b) by 0 days.

(21) Appl. No.: 14/388,372

(22) PCT Filed: Mar. 13, 2013

(86) PCT No.: PCT/US2013/030751
§ 371 (c)(1),
(2) Date: Sep. 26, 2014

(87) PCT Pub. No.: WO2013/148181
PCT Pub. Date: Oct. 3, 2013

(65) Prior Publication Data

US 2015/0090874 A1 Apr. 2, 2015

Related U.S. Application Data

(60) Provisional application No. 61/616,540, filed on Mar. 28, 2012.

(51) Int. Cl.
*H01J 49/00* (2006.01)
*H01J 49/06* (2006.01)

(52) U.S. Cl.
CPC ..... *H01J 49/004* (2013.01); *H01J 49/009* (2013.01); *H01J 49/0027* (2013.01); *H01J 49/0045* (2013.01); *H01J 49/061* (2013.01)

(58) Field of Classification Search
CPC ..... H01J 49/004; H01J 49/40; H01J 49/0027; H01J 49/0095; H01J 49/0045; H01J 49/061; H01J 49/406; H01J 49/0031; H01J 49/025; H01J 49/10; H01J 49/142; H01J 49/164; H01J 49/26; B01D 59/44
USPC ..... 250/281, 282, 283, 287, 288, 290, 292, 250/423 R, 424
See application file for complete search history.

(56) References Cited

U.S. PATENT DOCUMENTS 4,377,745 A * 3/1983 Chang ..... 250/283
4,507,555 A * 3/1985 Chang ..... 250/281

(Continued)

OTHER PUBLICATIONS

International Search Report and Written Opinion for PCT/US2013/030751, issued by the European Patent Office, Mar. 21, 2014; 13 pgs.

(Continued)

*Primary Examiner* — David A Vanore
(74) *Attorney, Agent, or Firm* — Mueting, Raasch & Gebhardt, P.A.

(57) ABSTRACT

A system and method for acquisition of mass spectrometry data is configured to provide a stream of charged particles (e.g., from an analytical volume). A primary mass spectrometer (e.g., time-of-flight mass spectrometer) may be used to separate charged particles of the stream of charged particles based on their mass-to-charge ratio and detect the charged particles in a mass-to-charge spectrum. A stream of precursor ions having a selected mass range may be diverted from the stream of charged particles for fragmentation to provide fragment ions (e.g., fragment ions from the analytical volume). The fragment ions may be provided to a second mass spectrometer for analysis of the fragment ions (e.g., during the same time as the time-of-flight mass spectrometer is separating and detecting charged particles of the stream of charged particles based on their mass-to-charge ratio).

19 Claims, 13 Drawing Sheets

(56) References Cited

U.S. PATENT DOCUMENTS

| | | | | |
|---|---|---|---|---|
| 5,032,722 | A | 7/1991 | Boesl et al. | |
| 5,128,543 | A | 7/1992 | Reed et al. | |
| 5,206,508 | A | 4/1993 | Alderdice et al. | |
| 6,441,369 | B1 * | 8/2002 | Vestal et al. | 250/287 |
| 6,888,130 | B1 * | 5/2005 | Gonin | 250/287 |
| 7,087,898 | B2 * | 8/2006 | Willoughby et al. | 250/288 |
| 7,235,796 | B2 * | 6/2007 | Kolodney et al. | 250/492.21 |
| 7,385,187 | B2 * | 6/2008 | Verentchikov et al. | 250/287 |
| 7,514,675 | B2 * | 4/2009 | Yamaguchi | 250/287 |
| 7,858,929 | B2 * | 12/2010 | Makarov et al. | 250/282 |
| 7,982,184 | B2 * | 7/2011 | Sudakov | 250/287 |
| 7,999,223 | B2 * | 8/2011 | Makarov et al. | 250/290 |
| 8,080,787 | B2 * | 12/2011 | Rather et al. | 250/290 |
| 8,637,815 | B2 * | 1/2014 | Makarov et al. | 250/290 |
| 8,674,293 | B2 * | 3/2014 | Makarov et al. | 250/287 |
| 8,716,660 | B2 * | 5/2014 | Green et al. | 250/292 |
| 8,847,155 | B2 * | 9/2014 | Vestal | 250/287 |
| 2001/0054684 | A1 * | 12/2001 | Park | 250/287 |
| 2004/0079873 | A1 * | 4/2004 | Bateman et al. | 250/281 |
| 2004/0079874 | A1 * | 4/2004 | Bateman et al. | 250/281 |
| 2004/0108452 | A1 * | 6/2004 | Graber et al. | 250/281 |
| 2005/0040326 | A1 * | 2/2005 | Enke | 250/288 |
| 2007/0029473 | A1 | 2/2007 | Verentchikov | |
| 2008/0073498 | A1 | 3/2008 | Kovtoun | |
| 2009/0206248 | A1 | 8/2009 | Makarov et al. | |
| 2011/0147578 | A1 * | 6/2011 | Schultz et al. | 250/282 |
| 2011/0226941 | A1 | 9/2011 | Gorenstein et al. | |
| 2013/0020482 | A1 * | 1/2013 | Enke et al. | 250/282 |
| 2013/0181125 | A1 * | 7/2013 | Guna et al. | 250/282 |
| 2013/0306856 | A1 * | 11/2013 | Trimpin et al. | 250/282 |
| 2014/0361156 | A1 * | 12/2014 | Soldin et al. | 250/282 |
| 2015/0090874 | A1 * | 4/2015 | Larson et al. | 250/282 |

OTHER PUBLICATIONS

International Preliminary Report on Patentability for PCT/US2013/03075 1, issue by the International Bureau of WIPO, Oct. 9, 2014; 10 pgs.

Andersson et al., "Imaging mass spectrometry of proteins and peptides: 3D volume reconstruction," *Nature Methods*, Jan. 2008;5(1):101-108.

Carado et al., "Cluster SIMS with a hybrid quadrupole time-of-flight mass spectrometer," *Appl. Surf Sci.*, 2008;255:1.610-1613.

Fletcher et al., "A New Dynamic in Mass Spectral Imaging of Single Biological Cells," *Anal. Chem.*, Dec. 1, 2008;80(23):9058-9064.

Luxembourg et al.., "High-Spatial Resolution Mass Spectrometric Imaging of Peptide and Protein Distributions on a Surface," *Anal. Chem.*, Sep. 15, 2004;76(18):5339-5344.

McDonnell et al., "Imaging Mass Spectrometry," *Mass Spectromery Reviews*, 2007;26:606-643.

Schueler, "TOF-SIMS with a Stigmatic Ion Microscope," in *Secondary Ion Mass Spectrometry*. Benninghoven et al., (Ed.). John Wiley & Sons: Chichester, 1990. Cover pg., publisher's pg., and pp. 311-314.

Stephens, "A Pulsed Mass Spectrometer with Time Dispersion," *Physical Review*, Proceedings of the American Physical Society, 1946;69(11 & 12):pp. 674-702.

Touboul et al., "Structural analysis of secondary ions by post-source decay in time-offlight secondary ion mass spectrometry," *Rapid Commun*. Mass Spectro., 2006;20:703-709.

* cited by examiner

METHOD AND APPARATUS TO PROVIDE PARALLEL ACQUISITION OF MASS SPECTROMETRY/MASS SPECTROMETRY DATA

CROSS REFERENCE TO RELATED APPLICATIONS

This application is the §371 U.S. National Stage of International Application No. PCT/US2013/030751, filed 13 Mar. 2013, which claims the benefit of U.S. Provisional Application Ser. No. 61/616,540, filed 28 Mar. 2012, entitled "Method And Apparatus To Provide Parallel Acquisition Of Mass Spectrometry/Mass Spectrometry Data," which are incorporated herein by reference in their entireties.

TECHNICAL FIELD

The present disclosure relates to the chemical and/or molecular analysis of materials. More particularly, for example, the present disclosure relates to the mass spectrometry analysis of materials (e.g., analysis of one or more surface layers of materials, including solids and biomaterials).

BACKGROUND

The chemical and molecular analysis of the surface and thin surface layers of solid materials is usually based on the energetic stimulation of the sample surface and the mass spectrometry analysis of fragments ejected from the surface. There are two commonly used types of instruments used for this type of analysis.

The first of the two common types of instruments is based on the use of "primary" ion beams to excite the sample and to eject charged atomic and molecular species (referred to as "secondary" ions) that are analyzed by a mass spectrometer. This type of instrumental technique is normally called Secondary Ion Mass Spectrometry (SIMS). The SIMS instrument may also have an additional mode of ionizing neutral fragments that are emitted at the same time as the secondary ions and this mode of operation is normally called Post Ionization SIMS. To obtain the highest collection efficiency, sensitivity, and separation of the different species based on the mass-to-charge (m/z) ratio of these species, a Time-of-Flight (TOF) mass spectrometer may be used in this SIMS instrument. The technique is therefore commonly referred to as TOF-SIMS. The TOF-SIMS instrument may be used in various other operating modes. For example, with the use of a scanned, micro-focused primary ion beam, mass resolved images of the sample can also be obtained with the TOF-SIMS instrument; this is generally known as the microprobe mode of operation. Further, a microscope mode of operation of the TOF mass spectrometer can also be used to obtain mass resolved images of the sample with the TOF-SIMS instrument. Exemplary embodiments thereof, for example, are described in U.S. Pat. No. 5,128,543, herein incorporated by reference.

The second type of instrument uses a photon source to excite the sample material to cause the ejection of fragments from the surface. The analysis of the fragments emitted as charged particles (i.e., ions) from the surface by a mass spectrometer is commonly known as Laser Desorption Mass Spectrometry. To increase the efficiency of the emission of charged particles (i.e., ions), specially selected organic matrix materials can be added to the surface of the sample. This refinement is commonly known as Matrix Assisted Laser Desorption Ionization (MALDI). To obtain the highest collection efficiency, sensitivity and separation of the different emitted species based on the mass-to-charge ratio, a Time-of-Flight mass spectrometer is normally used in this MALDI instrument although other types of mass spectrometers have also been used in MALDI instruments. With the use of a scanning stage and a micro-focused laser photon source, mass resolved images of the sample can also be obtained with MALDI; this is generally known as the microprobe mode of operation. A microscope mode of operation of the TOF mass spectrometer can also be used to obtain mass resolved images of the sample with MALDI analysis. Exemplary embodiments thereof, for example, are described in the article, S. L. Luxembourg, et al., "High Spatial Resolution Mass Spectrometric Imaging of Peptide and Protein Distributions on a Surface Imaging Mass Spectrometry", *Anal. Chem.* 2004 76(18) 5339-5344 as well as in the article, L. A. McDonnell et al., "Imaging Mass Spectrometry", *Mass Spectrometry Reviews,* 2007, 26, 606-643, both herein incorporated by reference.

The unique identification of the charged species emitted with either the TOF-SIMS or the MALDI techniques was historically based on the high mass resolution and mass accuracy of the TOF mass spectrometer. However, for mass-to-charge species (m/z species) with a mass above approximately 500 dalton (Da), the mass resolution and mass accuracy of the TOF mass spectrometer may not provide a unique molecular fragment identification of the emitted species. Historically, for the mass spectrometry analysis of higher mass liquid and gas phase molecules, a technique of Mass Spectrometry/Mass Spectrometry (MS/MS) has been used to provide a unique molecular fragment identification of many high mass species. This technique is based on the selection of a high mass ion in a first stage mass spectrometer (referred to as a "precursor" ion), followed by an energetic activation resulting in fragmentation of the precursor ion, followed by a second mass spectrometry analysis of the resulting fragment ions. Exemplary embodiments thereof, for example, are described by Boesl et al. in U.S. Pat. No. 5,032,722, herein incorporated by reference. The use of MALDI MS/MS is discussed in Andersson, et al., "Imaging Mass Spectrometry of Proteins and Peptides: 3D Volume Reconstruction", *Nature Methods* 2008 5, 101-108 as well as L. A. McDonnell et al, "Imaging Mass Spectrometry", *Mass Spectrometry Reviews* 2007, 26, 606-643, both herein incorporated by reference.

Exemplary methods and apparatus to obtain MS/MS data with the mass spectrometry spectral data containing both the precursor ion data and the fragment ion data, along with exemplary embodiments thereof, are described by Alderdice, et al. in U.S. Pat. No. 5,206,508, herein incorporated by reference. The apparatus described in U.S. Pat. No. 5,206,508 provides a tandem mass spectrometry system, capable of obtaining tandem mass spectra for each parent ion without separate spectra of precursor ions of differing mass from fragment ions of different mass. The data shown in FIG. 4 of U.S. Pat. No. 5,206,508 illustrate the overlap in the spectral display of the precursor ions and the fragment ions. This spectral overlap of precursor and fragment ions is a result of the single detector after the second mass analyzer. The overlapping of the data in the spectra makes this method and apparatus unworkable for polymer and biological samples that are typical for imaging MALDI and imaging TOF-SIMS analyses.

There are, for example, three apparatus concepts that may provide imaging TOF-SIMS data with MS/MS data based on a sequential mode of operation (e.g., imaging precursor ion mass spectrometry analysis followed by fragment ion mass spectrometry analysis). These three apparatus concepts require that a choice be made between the acquisition of secondary ion (e.g., precursor ion) mass spectrometry data or fragment ion mass spectrometry data. This defines the sequential nature of the instrument operation in such apparatus concepts. This sequential mode of operation prevents analytical TOF-SIMS data and MS/MS data from being acquired from the same analytical sample volume.

The first apparatus concept is based on a reflectron analyzer which allows the rejection of the precursor ions before the ion mirror and allows the fragment ions that result from precursor ion uni-molecular ion decay in the flight path between the sample and the reflectron to be mass analyzed (see, e.g., D. Touboul, et al., *Rapid Commun. Mass Spectrom.* 2006; 20: 703-709, herein incorporated by reference). This apparatus concept depends on the creation of fragment ions by the in-flight decay of metastable ions and is referred to as post-source decay (PSD). This described apparatus concept does not include an activation device between the reflectron used for precursor ion TOF-SIMS and a second mass spectrometer for acquisition of a MS/MS fragment ion spectra.

The second apparatus concept is a hybrid triple quadrupole TOF mass spectrometer equipped with an ion gun to produce TOF-SIMS ions. The apparatus concept uses a series of three quadrupole mass spectrometers followed by an orthogonal TOF mass spectrometer to acquire precursor ion TOP-SIMS data. In a second mode of operation, the second quadrupole mass spectrometer may also be used to select a precursor ion from the TOF-SIMS imaging experiment. The third quadrupole can then be operated at high gas pressure (e.g., in an activation cell) to produce fragment ions that can be measured in the orthogonal TOF mass spectrometer (see, e.g., A. Carado, et al., *Appl. Surf. Sci.* 2008; 255: 1610-1613, herein incorporated by reference). This described apparatus concept does not simultaneously and in parallel measure the precursor ion TOF-SIMS imaging data and the fragment ion MS/MS data.

The third apparatus concept is a reflectron analyzer with an integral gas collision cell in the reflectron flight path. This apparatus concept requires a choice between the acquisition of the precursor ions for imaging TOF-SIMS or the use of a high pressure gas in the collision cell to activate the precursor ions to produce fragment ions which can be mass analyzed in the rest of the reflectron flight path (see, J. S. Fletcher, et al., *Anal. Chem.* 2008; 80 9058-9064, herein incorporated by reference). This product concept cannot simultaneously and in parallel measure the precursor ion TOF-SIMS imaging data and the fragment ion MS/MS data.

SUMMARY

The present disclosure provides apparatus, methods, and systems that may, for example, add the capability of Mass Spectrometry/Mass Spectrometry (MS/MS) to a primary mass spectrometer instrument (e.g., to a Time-of-Flight Secondary Ion Mass Spectrometry (TOF-SIMS) instrument) in a way that improves the function and analytical benefits of materials analysis. In one or more embodiments of the apparatus, methods, and/or systems, MS/MS data is acquired in parallel with imaging data of a primary mass spectrometer (e.g., imaging TOF-SIMS data). For example, at least in one embodiment, this allows TOF-SIMS data to be acquired from the same analytical sample volume as the MS/MS data. Acquired in such a manner, the MS/MS data may therefore be used to provide confident molecular fragment, and, therefore, precursor ion, identification from the same analytical sample volume as the TOF-SIMS data.

In the examples of MS/MS combined with SIMS described in the Background section hereof, the instruments can operate in either the conventional SIMS mode or the MS/MS mode, but they cannot operate in the two modes simultaneously and in parallel. For example, with respect to the first apparatus concept described in the Background section hereof, this described apparatus concept does not include an activation device between the reflectron used for precursor ion TOF-SIMS and a second mass spectrometer for acquisition of a MS/MS fragment ion spectra, and as such, cannot operate in the two modes simultaneously and in parallel. With respect to the second apparatus concept described in the Background section herein, the hybrid triple quadrupole TOF mass spectrometer equipped with an ion gun to produce TOF-SIMS ions does not simultaneously and in parallel measure the precursor ion TOF-SIMS imaging data and the fragment ion MS/MS data. Further, with respect to the third apparatus concept described in the Background section herein, this reflectron analyzer requires a choice between the acquisition of the precursor ions for imaging TOF-SIMS or the use of a high pressure gas in the collision cell to activate the precursor ions to produce fragment ions which can be mass analyzed in the rest of the reflectron flight path, and as such, cannot simultaneously and in parallel measure the precursor ion TOF-SIMS imaging data and the fragment ion MS/MS data.

In one or more embodiments of the apparatus, methods, and systems described herein, either the microprobe mode or microscope mode of imaging may be used to provide parallel acquisition from the same analytical volume of both primary mass spectrometer data (e.g., TOF-SIMS data) and separate precursor ion mass spectrometry data with fragment ion MS/MS data. In one or more embodiments, such apparatus, methods, and systems may provide for the parallel acquisition of both MALDI data in the microscope mode (e.g., stigmatic direct ion imaging) and separate precursor ion mass spectrometry data with fragment ion MS/MS data. Further, unlike the undesirable overlapping of data described in U.S. Pat. No. 5,206,508 with respect to precursor ions and fragment ions, one or more embodiments of the apparatus, methods, and systems described herein may be used to obtain separate precursor ion spectra and fragment ion spectra from mass selected precursor ions in two separate data streams from the same analytical volume.

In one embodiment of an exemplary method for the acquisition of mass spectrometry data (e.g., TOF data and/or MS/MS data), the method may include applying an excitation pulse to a sample resulting in a stream of charged particles, using a primary mass spectrometer (e.g., a time-of-flight mass spectrometer) to separate charged particles of the stream of charged particles based on their mass-to-charge ratio and detecting the charged particles in a mass-to-charge spectrum, and diverting from the stream of charged particles a stream of one or more precursor ions having a selected mass range for fragmentation to provide fragment ions. The fragment ions may be provided to a second mass spectrometer for analysis of the fragment ions during the same time as the primary mass spectrometer is separating and detecting charged particles of the stream of charged particles based on their mass-to-charge ratio.

In one embodiment of the method, diverting from the stream of charged particles a stream of precursor ions may include activating the diverted stream of precursor ions for the production of the fragment ions and providing a mass spectrometry analysis of the mass-to-charge spectrum of a plurality of masses of the fragment ions.

In another embodiment of an exemplary method for the acquisition of mass spectrometry data, the method may include applying an excitation pulse to a sample resulting in a stream of charged particles from an analytical volume, using a primary mass spectrometer (e.g., a time-of-flight mass spectrometer) to separate charged particles of the stream of charged particles from the analytical volume based on their mass-to-charge ratio and detecting the charged particles in a mass-to-charge spectrum, and providing fragment ions to a second mass spectrometer for analysis of the fragment ions (e.g., the fragment ions may be provided by fragmentation of selected particles from the resulting stream of charge particles from the analytical volume).

In one embodiment of an exemplary apparatus for acquiring mass spectrometry data (e.g., TOF data and/or MS/MS data), the apparatus may include a primary mass spectrometer (e.g., a time-of-flight mass spectrometer) configured to separate charged particles of a stream of charged particles based on their mass-to-charge ratio and detecting the charged particles in a mass-to-charge spectrum, a selection apparatus configured to select a mass range of precursor ions from the stream of charged particles, an activation apparatus configured to activate and fragment the selected precursor ions during the same time as the primary mass spectrometer separates and detects charged particles based on their mass-to-charge ratio, and a second mass spectrometer configured for mass-to-charge analysis of a plurality of masses of the fragment ions provided from the activation apparatus.

One or more embodiments of the methods and/or apparatus may include one or more of the following features: the primary mass spectrometer may include a time-of-flight mass spectrometer; the primary mass spectrometer may acquire at least one of spatially resolved mass spectrometry spectra, spatially resolved mass spectrometry images, and spatially resolved depth profiles with the spatial resolution defined by the dimensions of an incident energetic probe on the sample surface; the primary mass spectrometer may acquire at least one of spatially resolved mass spectrometry spectra, spatially resolved mass spectrometry images, and spatially resolved depth profiles with the spatial resolution defined by parallel microscope imaging of a first spectrometer ion optics; an excitation probe configured to provide the stream of charged particles may include an ion beam or a laser beam (e.g., a focused ion beam or a focused laser beam); the selection apparatus may include a three aperture structure with an electrically activatable center aperture (e.g., wherein the selection apparatus may be pulse activatable to extract selected mass-to-charge precursor ions from the stream of charged particles provided by the primary mass spectrometer and inject the selected precursor ions into the activation apparatus and the subsequent second mass spectrometer for mass spectrometry/mass spectrometry analysis); the activation apparatus may be configured to provide activation and fragmentation of the precursor ions by either collision induced dissociation (CID) in a chamber containing a gas, electron beam induced dissociation, photon beam induced dissociation, or surface induced dissociation; the stream of charged particles may include portions thereof corresponding to each of one or more pulses of an excitation probe; a selection apparatus may be operable to select a mass range of precursor ions from portions of the stream of charged particles corresponding to a selected percentage of the one or more pulses under computer control for parallel mass spectrometry/mass spectrometry analysis; the time-of-flight mass spectrometer may include a TRIFT (Triple Ion Focusing Time-of-Flight Mass Analyzer) spectrometer; the second mass spectrometer may include a linear TOF spectrometer, a reflectron TOF spectrometer, or an orthogonal TOF spectrometer; an excitation probe may include an ion beam, wherein the ion beam may include at least one of monatomic ion species, polyatomic cluster ion species, molecular ion species, and polymolecular cluster ion species (e.g., at least one of $Ga^+$, $In^+$, $SF_5^+$, $C_{60}^+$, $C_{60}^{2+}$, $C_{70}^+$, $C_{70}^{2+}$, $C_{12}H_{24}^+$, $Au^+$, $Au_3^+$, $Au_3^{2+}$, and $Bi_n^{q+}$ where n=1, 2, 3, 5, or 7 and q=1 or 2); and/or an excitation probe may include a gas cluster ion beam (e.g., a gas cluster ion beam that includes $Ar_n^+$, where n is an integer between 1 and 5,000).

The above summary is not intended to describe each embodiment or every implementation of the present disclosure. A more complete understanding will become apparent and appreciated by referring to the following detailed description and claims taken in conjunction with the accompanying drawings.

DETAILED DESCRIPTION OF EXEMPLARY EMBODIMENTS

Figure 1:
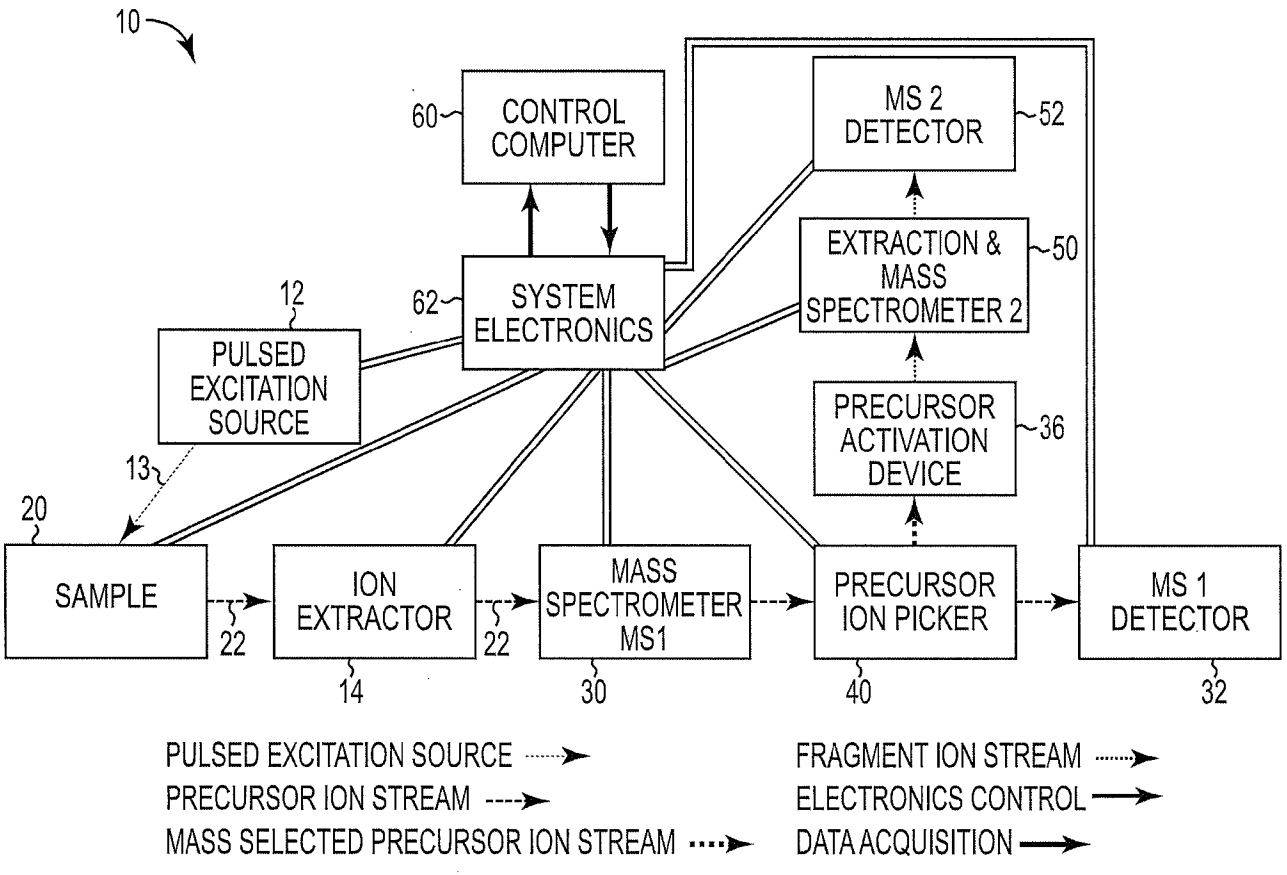
FIG. 1 is a general block diagram of an exemplary system to perform parallel acquisition of MS/MS data.

In the following detailed description of illustrative embodiments, reference is made to the accompanying figures of the drawing which form a part hereof, and in which are shown, by way of illustration, specific embodiments which may be practiced. It is to be understood that other embodiments may be utilized and structural/process changes may be made without departing from the scope of the present disclosure. Unless stated otherwise herein, the figures of the drawing are rendered primarily for clarity and thus may not be drawn to scale.

Methods herein are described in a particular illustrated order. However, orders other than the ones illustrated are feasible. It is furthermore feasible that additional process steps not listed in the method may be carried out. It is additionally possible for individual method steps or groups of method steps to be carried out repeatedly or to be carried out such that they overlap at least partially in terms of time.

Figure 2:
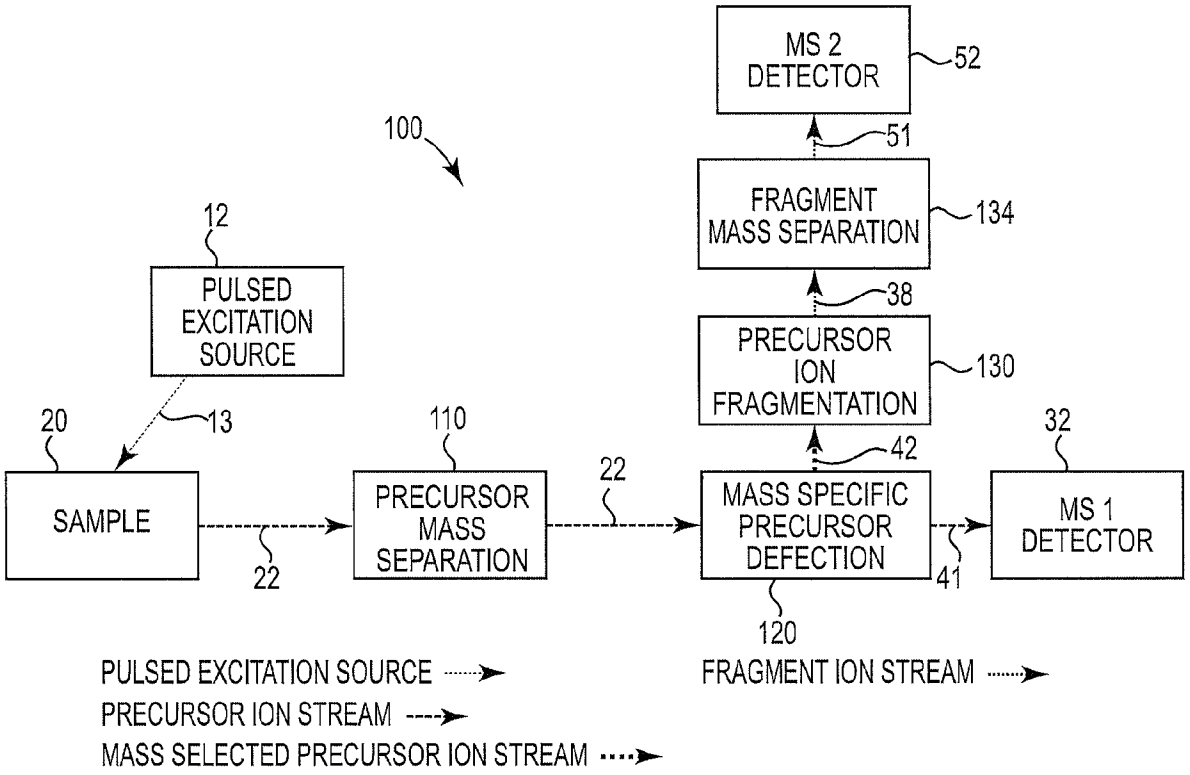
FIG. 2 is a general block diagram of an exemplary method of parallel acquisition of MS/MS data as may be implemented by a system such as shown in FIG. 1.

One or more embodiments of apparatus, methods, and/or systems used for the acquisition of mass spectrometry data (e.g., MS/MS data acquired in parallel with imaging TOF-SIMS data) are described with reference to FIGS. 1-13. FIG. 1 shows a general block diagram of an exemplary system 10 to acquire mass spectrometry data (e.g., perform parallel acquisition of MS/MS data). FIG. 2 shows a general block diagram of an exemplary method 100 of parallel acquisition of MS/MS data as may be implemented by a system such as shown in FIG. 1.

The exemplary system 10 as shown in the block diagram of FIG. 1 may include an ion extractor 14, a first or primary mass spectrometer 30 (MS1) (e.g., a TOF mass spectrometer) and a MS1 detector 32, a precursor ion selection apparatus 40, a precursor ion activation device 36, and an extraction and second mass spectrometer 50 (MS2) and associated MS2 detector 52. Further, the system 10 includes a control computer component 60 that includes all processing hardware and software programs for computer control of the system electronics 62 for carrying out the functionality of the system 10 described herein. Still further, the system 10 includes a controlled excitation source (e.g., a pulsed excitation source 12) for use in providing a stream of charged particles for analysis by the system 10.

One exemplary embodiment of an apparatus for acquiring mass spectrometry data (e.g., configured to carry out one or more methods described herein) may include a TOF mass spectrometer (e.g., such as a TOF mass spectrometer including an ion extractor 14, mass spectrometer optics 30 and associated MS1 detector 32) configured to separate charged particles from a stream of charged particles 22 based on their mass-to-charge ratio and detecting the charged particles in a mass-to-charge spectrum, a selection apparatus (e.g., a precursor ion selection apparatus 40) configured to select a mass range of precursor ions from the stream of charged particles 22 (e.g., such as the selection apparatus shown in FIG. 11), a precursor ion activation apparatus 36 configured to activate and fragment the selected precursor ions (e.g., see such an activation apparatus in FIGS. 5, 6A and 6B) during the same time as the primary mass spectrometer (e.g., a TOF mass spectrometer) separates and detects charged particles based on their mass-to-charge ratio, and a second mass spectrometer (e.g., such as a mass spectrometer including extraction and mass spectrometer optics 50 and associated MS2 detector 52) configured for mass-to-charge analysis of a plurality of masses of the fragment ions 38 (e.g., some or all masses) provided from the activation apparatus 36.

In one or more embodiments, the ion extractor 14, the first or primary mass spectrometer 30 (MS1) and associated MS1 detector 32 may be components of a TOF analyzer used within currently available TOF-SIMS and/or MALDI systems. In one or more embodiments of such systems, the precursor ion selection apparatus 40 may be placed within an ion stream of such TOF-SIMS and/or MALDI systems. Still further, for example, the precursor activation device 36, extraction (e.g., with ion bunching) into second mass spectrometer 50 and the MS2 detector 52 may be provided as part of a MS/MS TOF-SIMS system or a MS/MS MALDI system that includes parallel acquisition of MS and MS/MS data from the same analytical volume as described herein.

The generalized exemplary flow diagram of one embodiment of the operation of an exemplary system 10 (e.g., a MS/MS TOF-SIMS system or a MS/MS MALDI system) with parallel acquisition of primary mass spectrometry data and MS/MS data from the same analytical volume as shown in FIG. 2 includes using the pulsed excitation source 12 to create a series of ions from the sample 20 (e.g., each pulse of the excitation source resulting in a corresponding portion of a stream of charged particles provided by one or more pulses of the excitation source). In one or more embodiments, the pulsed excitation source 12 may be either an ion source or photon source (e.g., a focused ion source or a focused laser source). The series of ions from the sample 20 (which may be referred to herein as precursor ions) form the precursor ion stream 22 (e.g., a stream of charged particles). The precursor ion stream 22 (e.g., a series of ions based on the repetition of the pulsed excitation source 12) may be mass separated in a precursor mass separation process (block 110) (e.g., by the ion extractor 14). This precursor mass separation (block 110) may be based on a microprobe mode of operation or a microscope mode of operation (e.g., a microprobe based TOF mode of operation or a microscope (direct imaging) based TOF mode of operation).

After, for example, mass separation (e.g., desired and/or sufficient separation) of the stream of precursor ions 22 (block 110) in the first mass spectrometer analyzer (e.g., a TOF mass spectrometer analyzer) including, e.g., the ion extractor 14, the first mass spectrometer 30 (MS1) and associated MS1 detector 32), and before the stream of precursor ions are detected by the first mass spectrometer MS 1 detector 32 (block 122), a user defined specific mass region of the stream of precursor ions 22 may be deflected in a mass specific precursor deflection process (block 120) (e.g., by a precursor ion selection apparatus 40) (e.g., resulting in a diverted mass selected precursor ion stream 42 and the remainder of the stream of precursor ions 41 being provided to the MS1 detector). Because the precursor ion stream 22 is a series of pulsed ions, the mass specific precursor deflection (block 120) can be controlled to deflect all of a narrow mass range of precursor ions from all of the series of pulsed ions in the stream 22 or a user defined fraction of the series of mass specific precursor ions in the stream 22. This, for example, allows the entire mass spectrum of the precursor ions in the stream 22 to be recorded at the MS1 detector 32. Based on a user defined percentage of cycles that are deflected in the mass specific precursor deflection process (block 120), the intensity of ions recorded at the MS1 detector 32 within the mass region deflected in the mass specific precursor defection process (block 120) may be normalized to reflect the percentage of deflected cycles. This allows the spectrum recorded at the MS1 detector 32 to represent an accurate intensity distribution of precursor ions within the complete mass range of precursor ions. At least in one embodiment, the stream of charged particles from the excitation of the sample (e.g., precursor ions) may include portions thereof corresponding to each of one or more pulses of an excitation probe. The selection apparatus 40 may be operable to select a mass range of precursor ions from portions of the stream of charged particles corresponding to a selected percentage of the one or more pulses (e.g., the selection apparatus 40 may be activated under computer control to divert a mass range of precursor ions from portions of the stream of charged particles that correspond to a user defined percentage of the pulses such that the diverted precursor ion stream may be fragmented).

The deflected mass specific precursor ions 42 may be fragmented in a precursor ion fragmentation process (block 130) resulting in fragment ion stream 38 (e.g., using the precursor activation device 36). The resulting fragment ions 38 may then undergo fragment mass separation (block 134) (e.g., using the second mass spectrometer 50) and detection at the MS2 detector 52. For example, in one or more embodiments, the fragmentation process (block 130) of one cycle of precursor ions, the fragment ion mass separation (block 134), and the fragment ion detection by MS2 detector 52 occurs within the cycle time duration of one cycle of precursor ion mass separation (block 110). This may allow the concept to obtain with parallel acquisition both precursor ion MS data and fragment ion MS/MS data from the same analytical volume (e.g., from the same stream of precursor ions 22 provided during a period of time from the sample 20 using the pulsed excitation source 12).

For example, one embodiment of such a method for the acquisition of mass spectrometry data as shown generally in FIG. 1, may include applying an excitation pulse 13 to a sample 20 (e.g., using a pulsed excitation source 12) resulting in a stream of charged particles 22 (e.g., from an analytical volume), using a primary mass spectrometer (e.g., such as a TOF mass spectrometer including an ion extractor 14, mass spectrometer optics 30 and associated MS1 detector 32) to separate charged particles from the stream of charged particles based on their mass-to-charge ratio and detecting these charged particles in a mass-to-charge spectrum (see, for example, block 110 and block 32 of FIG. 2), and diverting from the stream of charged particles 22 a stream of precursor ions having a selected mass range of charged particles for fragmentation (e.g., using a selection apparatus) (block 120). The fragment ions 38 may be provided to a second mass spectrometer (e.g., such as a mass spectrometer including extraction and mass spectrometer optics 50 and associated MS2 detector 52) for analysis of the fragment ions 38 (e.g., to provide MS/MS data) during the same time as the primary mass spectrometer is separating and detecting charged particles of the stream of charged particles 22 based on their mass-to-charge ratio. For example, the diverting process may include activating the diverted stream of precursor ions for the production of fragment ions (e.g., precursor ion fragmentation process, block 130) and providing a mass spectrometry analysis of the mass-to-charge spectrum of a plurality of masses of the fragment ions (e.g., all of the masses of the fragment ions).

Further, for example, another embodiment of a method for the acquisition of mass spectrometry may include applying an excitation pulse 13 to a sample 20 resulting in a stream of charged particles 22 from an analytical volume, using a primary mass spectrometer (e.g., such as a TOF mass spectrometer including an ion extractor 14, mass spectrometer optics 30 and associated MS1 detector 32) to separate charged particles of the stream of charged particles from the analytical volume based on their mass-to-charge ratio and detecting these charged particles in a mass-to-charge spectrum (see, for example, block 110 and block 32 of FIG. 2), and providing fragment ions to a second mass spectrometer (e.g., such as a mass spectrometer including extraction and mass spectrometer optics 50 and associated MS2 detector 52) for analysis of the fragment ions (e.g., wherein the fragment ions 38 are provided by fragmentation of selected particles from the stream of charge particles 22 from the analytical volume). In other words, in one embodiment, the MS/MS data may be acquired (e.g., using the second mass spectrometer) in parallel with imaging primary mass spectrometry data (e.g., TOF-SIMS data using a TOF mass spectrometer).

As used herein, an analytical volume refers to a volume of the sample, bounded by the sample surface, from which precursor ions, and fragment ions derived from the activation and fragmentation of selected precursor ions, are provided to other components of a system for analysis thereof.

The primary mass spectrometer (i.e., mass spectrometer MS1) used to provide the functionality described herein may be any suitable mass spectrometer (e.g., a TOF mass spectrometer, a TRIFT mass spectrometer, etc.). In one or more embodiments of the apparatus or methods described herein, the primary mass spectrometer (e.g., a TOF mass spectrometer) may acquire at least one of mass spectrometry spectra (e.g., spatially resolved mass spectrometry data), mass spectrometry images (e.g., spatially resolved mass spectrometry images), and/or depth profiles (e.g., spatially resolved depth profiles with the spatial resolution defined by the dimensions of an incident energetic probe on the sample surface) (otherwise referred to as microprobe mode of operation). Further, in one or more embodiments of the apparatus or methods described herein, the TOF mass spectrometer may acquire mass spectrometry spectra (e.g., spatially resolved mass spectrometry data), mass spectrometry images (e.g., spatially resolved mass spectrometry images), and/or depth profiles (e.g., spatially resolved depth profiles with the spatial resolution defined by parallel microscope imaging of a first spectrometer ion optics) (otherwise referred to as microscope mode of operation). In one or more embodiments of the apparatus or methods described herein, an excitation probe configured to provide the stream of charged particles may include an ion beam or a laser beam.

The excitation source 12 (e.g., a pulsed excitation source) may be any excitation source suitable for use in providing a stream of precursor ions 22 (e.g., charged particles) for analysis. For example, in one or more embodiments, the excitation source may include an ion beam or a laser beam. Further, in one or more embodiments of the apparatus or methods described herein, the excitation probe configured to provide the stream of charged particles may include a focused ion beam or a focused laser beam. For example, in one or more embodiments, the excitation probe may include an ion beam (e.g., a focused ion beam) with the ion beam including at least one of monatomic ion species, polyatomic cluster ion species, molecular ion species, and poly-molecular cluster ion species. For example, the ion beam may include at least one of, for example, $Ga^+$, $In^+$, $SF_5^+$, $C_{60}^+$, $C_{60}^{2+}$, $C_{70}^+$, $C_{70}^{2+}$, $C_{12}H_{24}^+$, $Au^+$, $Au_2^+$, $Au_3^+$, $Au_3^{2+}$, or $Bi_n^{q+}$ where n=1, 2, 3, 5, or 7 and q=1 or 2. Further, for example, the ion beam may include glycerol, $C_3H_8O_{3n}^+$, where n is greater than or equal to 1. Still further, in one or more embodiments of the apparatus or methods described herein, an excitation probe may include a gas cluster ion beam. For example, such a gas cluster ion beam may include $Ar_n^+$ where n is an integer between 1 and 5,000.

The precursor ion selection apparatus 40 may be any suitable apparatus configured to extract selected mass-to-charge precursor ions 22 from the stream of charged particles 22 provided by the TOF mass spectrometer. For example, in one or more embodiments, the selection apparatus may include a three aperture structure with an electrically activatable center aperture (e.g., wherein the selection apparatus may be pulse activatable to extract selected mass-to-charge precursor ions from the stream of charged particles provided by the time-of-flight mass spectrometer) and inject the selected precursor ions into the 36 activation apparatus and the subsequent second mass spectrometer 50 for MS/MS analysis. One or more embodiments of exemplary selection apparatus are further described herein.

The precursor ion activation apparatus 36 may be any suitable apparatus configured to provide activation and fragmentation of the precursor ions. As used herein, activation refers to any process of adding internal energy to any precursor ion, and further fragmentation refers to the separation of the activated ion into neutral and ionized fragments. In one or more embodiments, for example, the activation apparatus may be a device configured to provide activation and fragmentation by one of collision induced dissociation (CID) in a chamber containing a gas, electron beam induced dissociation, photon beam induced dissociation, or surface induced dissociation.

In one or more embodiments of the apparatus or methods described herein, a percentage, between, for example, 100% and 0%, of the pulsed precursor ion beams may be chosen by the control computer for parallel MS/MS analysis. The control computer may select a specific m/z precursor ion species from the entire mass range of precursor ions for parallel MS/MS analysis. This allows parallel acquisition from the same analysis volume of the entire precursor mass spectrum and the MS/MS mass spectrum of the selected precursor ion species.

The second mass spectrometer (e.g., mass spectrometer MS2, including extraction and mass spectrometer optics 50 and associated MS2 detector) used to provide the functionality described herein may be any suitable mass spectrometer configured for use in generating MS/MS data. In one or more embodiments of the apparatus or methods described herein, the second mass spectrometer may include a linear TOF spectrometer, a reflectron TOF spectrometer, or an orthogonal TOF spectrometer. Further, for example, the second mass spectrometer may be a mass spectrometer that meets the analytical requirements of parallel acquisition of all fragment ion species from the activation and fragmentation of a single m/z precursor ion species, as well high mass resolution (e.g. >2000 M/Δm at 2000 m/z) and high mass accuracy from 0 to 2000 m/z).

A combined system (e.g., such as shown and described generally in FIGS. 1 and 2) for allowing detection at the MS1 detector 32 and MS2 detector 52 to provide precursor ion MS data (e.g., TOF mass spectrometry data) and fragment ion MS/MS data from the same analytical volume) may be provided in various ways. For example, in one or more embodiments, various components, systems, and/or apparatus described herein may be combined as a system to provide parallel processing of precursor ions and fragment ions (e.g., fragment secondary ions) from the same sample volume such as generally shown in FIGS. 1 and 2. For example, FIGS. 5-6 and 8-9 illustrate an exemplary implementation of an MS1 and MS2 tandem mass spectrometer to provide the functionality described herein (e.g., a TRIFT spectrometer as described herein may be modified to provide such an implementation). For example, as shown in FIG. 5 and further described herein, the MS2 optics beam path 200 (e.g., the diverted mass selected precursor ion stream 42; diverted by a selection apparatus 40 as generally shown in FIG. 1) is shown overlaid on an illustration of a TRIFT spectrometer (functioning as the first TOF mass spectrometer MS1 of the system 10 as generally described with reference to FIGS. 1 and 2). For example, in one or more embodiments, the width of the beam path corresponds to one degree of scatter in the collision cell (e.g., such as collision cell 230 as described further herein). Further, in one or more embodiments, the MS2 optics beam path 200 and the MS1 beam path (e.g., stream of precursor ions 22) lie in the same plane. As such, for example, in one or more embodiments, the components of the system are positioned so that the MS2 beam path crosses or is diverted from the MS1 beam path just before, for example, a first electrostatic analyzer (ESA1) 805 of a TRIFT spectrometer 800 as further described herein and as illustratively shown, for example, in FIGS. 3-4. Further, for example, as shown in FIG. 5, a TRIFT vacuum chamber 840 of a TRIFT spectrometer 800 as further described herein and as illustratively shown, for example, in FIGS. 3-4, is provided with an added mounting port for mounting components of the second mass spectrometer 50 (e.g., shown generally in FIG. 1) to provide the MS2 optics path (e.g., column) from the vacuum chamber 840.

Figure 3:
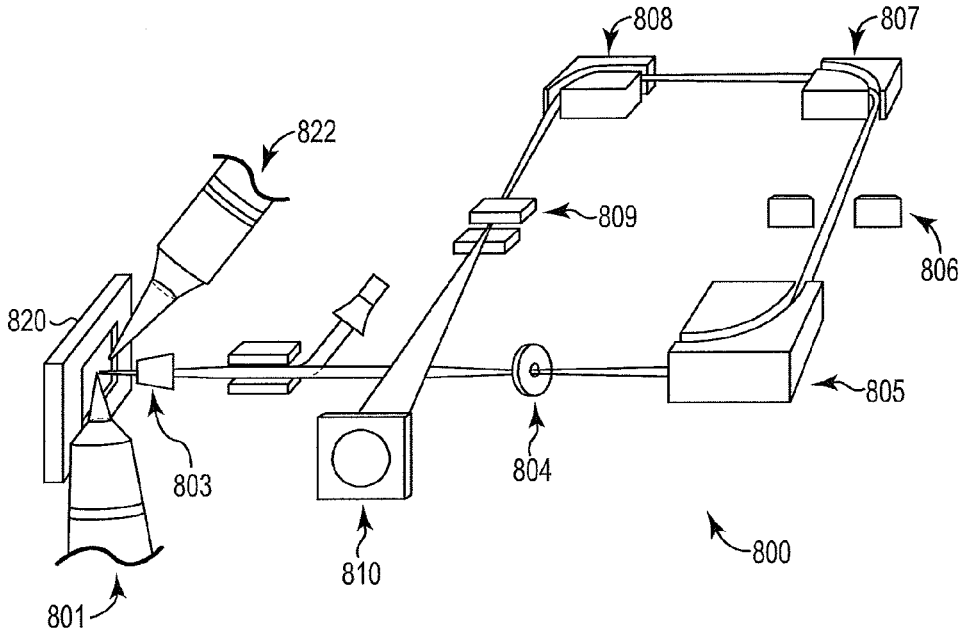
FIG. 3 is a schematic view of an exemplary TOF mass spectrometer including an exemplary first stage of mass spectrometry (MS1) optics.

One example of an existing TOF-SIMS apparatus that, for example, may be modified to provide the functionality described herein, is a PHI TRIFT V nanoTOF instrument (see, FIG. 3 which shows a TRIFT Spectrometer (Triple Ion Focusing Time-of-Flight Mass Analyzer) as described by B. Schueler, et al., *SIMS VII Proc.*, Wiley, Chichester, USA, 1989, which is incorporated herein by reference. For example, in the PHI TRIFT V nanoTOF, the mass-to-charge ratio, spatial position of origin based on the scanning position of the microprobe excitation source, and depth of origin of an ion produced by a scanned primary ion beam based on the previous flux of primary ions to the sample surface may be determined using a three sector TOF mass spectrometer. This may be commonly referred to as a microprobe based TOF-SIMS instrument. Previous implementations have also utilized the stigmatic optics (i.e., direct ion imaging or microscope mode) of this three sector TOF mass spectrometer to produce data of the mass-to-charge ratio, spatial position of origin based on the direct imaging optics of the spectrometer, and depth of origin of secondary ions based on the previous flux of primary ions to the sample surface. This second mode is commonly called the microscope mode of TOF-SIMS and was implemented beginning with the PHI TRIFT II TOF-SIMS instrument. The PHI TRIFT V nanoTOF TOF-SIMS and the PHI TRIFT II TOF-SIMS instruments identify the mass-to-charge ratio of the ions using a TOF mass spectrometer. The identification of the mass and structure of the secondary ions is limited by the mass resolution and mass accuracy of the TOF analyzer. The addition of an ion activation device 42 and a second stage of mass spectrometry (MS2) (e.g., mass spectrometer 50 and associated MS2 detector 52) as described herein allows the mass analysis of the ion fragments produced by activation of the precursor secondary ion selected (e.g., by precursor ion selection apparatus 40) in the first mass spectrometer to provide MS/MS data. The MS/MS spectrum allows the molecular fragment structural and elemental identification that cannot be achieved only by a conventional TOF-SIMS alone.

Figure 4:
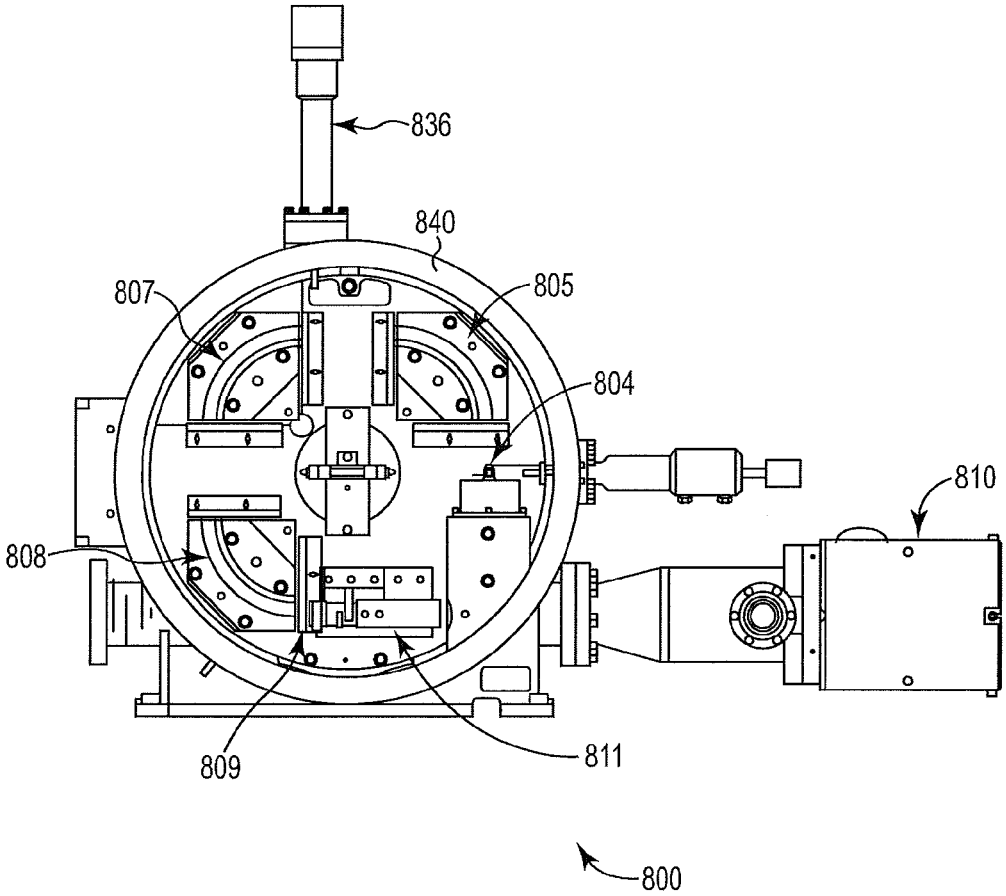
FIG. 4 is a computer aided drawing (CAD) drawing of a TOF spectrometer chamber with covers removed.
Figure 5:
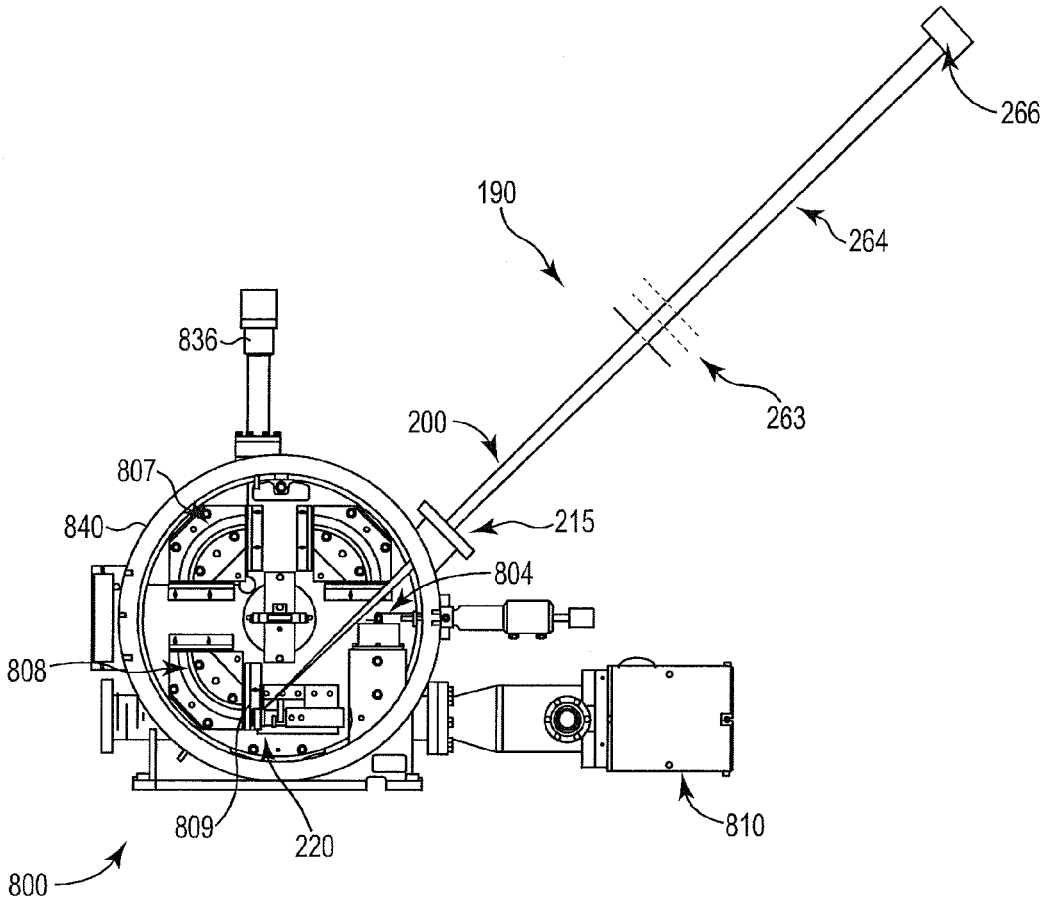
FIG. 5 is the drawing of FIG. 4 with an overlaid schematic of an exemplary second stage of mass spectrometry (MS2) optics.

FIGS. 3-4 shows an exemplary TOF mass spectrometer (e.g., a TOF mass spectrometer (MS1) configured to provide TOF mass spectrometry data) that may be modified according to the principles described herein. For example, such a time-of-flight mass spectrometer may be a PHI TRIFT V nanoTOF instrument available from Physical Electronics USA (MN). Such an instrument uses a Time-of-Flight TRIFT mass spectrometer, such as described by David A. Reed and Bruno W. Schueler in U.S. Pat. No. 5,128,543, which is incorporated by reference herein. A computer/data acquisition system such as shown and described in U.S. Pat. No. 5,128,543 (or as known to one skilled in the art) is used to control operation of the system of FIGS. 3-4 as well as other systems/modified systems as provided herein (e.g., including amplifiers, analog to digital convertors, buffers, or any other signal acquisition or processing components, including one or more programs executable by one or more processors).

For example, such a system may include processing apparatus and data storage. Data storage may allow for access to processing programs or routines and one or more other types of data that may be employed to carry out the illustrative methods or control the various processes described herein. For example, processing programs or routines may include programs or routines for performing computational mathematics, matrix mathematics, decomposition algorithms, compression algorithms (e.g., data compression algorithms), calibration algorithms, image construction algorithms, signal processing algorithms, standardization algorithms, comparison algorithms, vector mathematics, or any other processing required to implement one or more embodiments as described herein. Data may include, for example, sampled data, measurement data, signal data, electronic module status data from one or more system components, processing programs or routines employed according to the present disclosure, or any other data that may be necessary for carrying out the one or more processes described herein.

In one or more embodiments, the systems and/or methods may be implemented using one or more computer programs executed on programmable computers, such as computers that include, for example, processing capabilities, data storage (e.g., volatile or non-volatile memory and/or storage elements), input devices, and output devices. Program code and/or logic described herein may be applied to input data to perform functionality described herein and to generate desired output information. The output information may be applied as input to one or more other devices and/or processes as described herein or as would be applied in a known fashion.

The one or more programs used to implement the processes described herein may be provided using any programmable language, e.g., a high level procedural and/or object orientated programming language that is suitable for communicating with a computer system. Any such programs may, for example, be stored on any suitable device, e.g., a storage media, readable by a general or special purpose program, computer or a processor apparatus for configuring and operating the computer when the suitable device is read for performing the procedures described herein. In other words, at least in one embodiment, the system may be implemented using a non-transitory computer readable storage medium, configured with a computer program, where the non-transitory storage medium so configured causes the computer to operate in a specific and predefined manner to perform functions described herein.

The processing apparatus may be, for example, any fixed or mobile computer system (e.g., a personal computer or minicomputer). The exact configuration of the computing apparatus is not limiting and essentially any device capable of providing suitable computing capabilities and control capabilities may be used. Further, various peripheral devices, such as a computer display, mouse, keyboard, memory, printer, scanner, are contemplated to be used in combination with processing apparatus and data storage.

In FIG. 3-4, an optical system of the TOF mass spectrometer 800, such as, for example, the TRIFT optical system, is shown. At the left, an ion gun 801 (e.g., a liquid metal ion gun (LMIG)) may be used to irradiate the sample 820, for example, with a series of short pulses of ions energetic enough to produce a stream of secondary ions (also referred to as precursor ions) characteristic of the sample composition. The secondary or precursor ions may be accelerated (e g, immediately accelerated) by a strong electric field of an immersion lens 803 and directed toward an imaging aperture 804 and a first electrostatic analyzer (ESA1) 805. After acceleration, all the precursor or secondary ions may have nearly the same kinetic energy, and as such, the heavier ions will travel slower than lighter ions. The ESA1 805 in combination with an energy slit 806 allow only a certain band of energies to pass through to a second electrostatic analyzer (ESA2) 807 and a third electrostatic analyzers (ESA3) 808. Each of three ESA's may be used to turn the beam 90 degrees and also may be used to focus the stream of precursor ions. After the third analyzer (ESA3) 808, the stream of ions comes to a narrow waist at a post-ESA blanker 809 and continues to the detector 810 which provides an x,y detector position and time of arrival. An ion's mass may then be determined as it is related to the time-of-flight (TOF) from sample 20 to detector 810.

One feature of such a TOF spectrometer (e.g., the TRIFT TOF mass spectrometer) is a triple-focusing property thereof. The analyzer instrument shown in FIGS. 3-4 focuses spatially in two dimensions thus providing an image of the sample at the detector plane. Further, the instrument shown in FIGS. 3-4 (e.g., the TRIFT TOF mass spectrometer) may also focus in time; or in other words, secondary or precursor ions with the same mass but different energies take slightly different paths through the spectrometer so they have the same flight time.

FIG. 4 shows a drawing of the spectrometer shown in FIG. 3 (e.g., a TRIFT spectrometer) mounted in its vacuum chamber 840 with a cover removed (i.e., not shown) as viewed from above the perspective view in FIG. 3. The three ESA's 805, 807, and 808 are clearly visible with the detector chamber 810 on the right. The source chamber containing the sample 820 and ion gun(s) 801, 822 is not shown in this view. FIG. 4 also shows an energy slit control apparatus for controlling the energy slit 806 shown in FIG. 3.

As described herein, for example, in one or more embodiments, one or more components (e.g., a precursor ion selection apparatus, such as shown generally in FIG. 1 as selection or picker apparatus 40) may be positioned in a TOF mass spectrometer and configured to extract selected mass-to-charge precursor ions from the stream of charged particles provided by the TOF mass spectrometer. Further, an activation apparatus (e.g., an activation apparatus, such as shown generally in FIG. 1 as activation apparatus 36) and second mass spectrometer optics and associated detector (e.g., a second mass spectrometer, such as shown generally in FIG. 1 as extraction and mass spectrometer optics 50 and associated detector 52) may be added to the TOF mass spectrometer to allow for parallel path analysis of precursor ions and fragment ions to provide TOF mass spectrometry data and MS/MS data.

FIGS. 5-11 show components that may be used to modify a TOF spectrometer, such as the TRIFT spectrometer 800 as illustratively shown, for example, in FIGS. 3-4. For example, as shown in FIG. 5, a TRIFT vacuum chamber 840 of a TRIFT spectrometer 800 as illustratively shown, for example, in FIGS. 3-4, is provided with an added mounting port 215 for mounting components of the second mass spectrometer to provide an additional optics path from the vacuum chamber 840, such as for allow analysis of fragment ions and provision of MS/MS data. Other components (e.g., a selection apparatus, an activation apparatus, etc.) that allow for such functionality are positioned inside the vacuum chamber 840 as described herein.

For example, to perform the parallel functionality described herein requires a device (e.g., a precursor ion selection apparatus) for diverting a user definable percentage of the series of precursor ions of a selected mass (e.g., diverting a portion of the ions produced by the series of pulses of a primary ion source from the stream of precursor or secondary ions) provided by the first mass spectrometer (MS1) (e.g., from a stream of precursor ions provided by the TRIFT TOF mass spectrometer) for further analysis in a second mass spectrometer (MS2) (generally designated as reference numeral 190 in FIG. 5. Any suitable selection apparatus for diverting such ions may be used, and may be aptly referred to herein as a selection apparatus.

Figure 11:
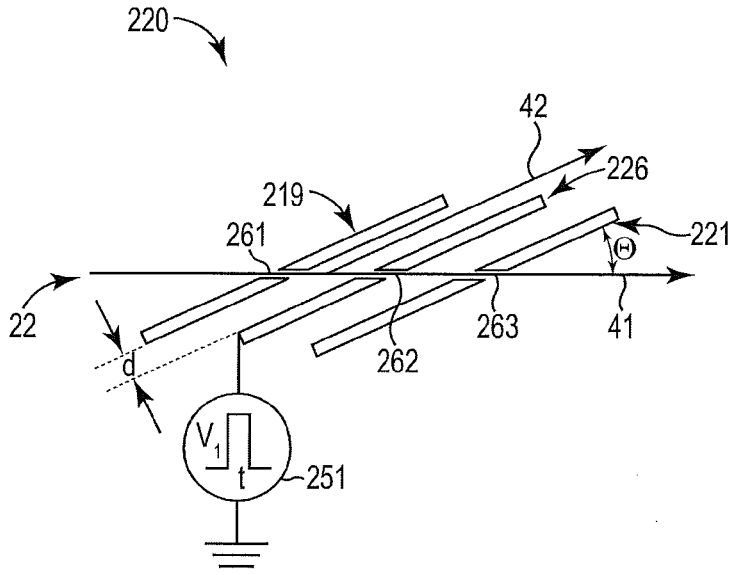
FIG. 11 is an exemplary schematic illustration for use in explaining aspects of an exemplary selection apparatus.

For example, one exemplary selection apparatus 220 (see FIG. 6B) may be constructed of multiple plates 219, 221 and 226 (e.g., three parallel plates) with through holes (i.e., each plate having an aperture extending through the plate with the openings aligned such that the stream of precursor ions may travel therethrough) for the stream of secondary or precursor ions 22 to enter (e.g., for the TRIFT TOF mass spectrometer beam to enter) as shown, for example, in FIG. 11. For example, the multiple plates 219, 221 and 226 may include three parallel plates. The three parallel plates may include a first outer plate electrode 219 and second outer plate electrode 221 which are held at constant potentials, usually ground. Further, a third middle electrode plate 226 of the three parallel plates, positioned between the first and second outer plate electrodes 219, 221, can be electrically energized as shown in FIG. 11 by application of a pulse 251 to the middle electrode plate 226.

When precursor or secondary ions of a selected mass (e.g., a user selected mass) have entered the gap (e.g., with an initial momentum $p=(2\ meV_0)^{1/2}$) between the outer electrode plate 219 and the middle electrode plate 226 (e.g., entered through the opening 261 in the outer electrode plate 219 and into the space between the outer electrode plate 219 and the middle or center electrode plate 226), the middle electrode plate 226 may be pulsed with the secondary or precursor ions receiving a momentum impulse equal to the electric field times the pulse width; the momentum impulse ($eV_1t/d=p\ \sin(\Theta)$). With such a momentum impulse being applied, precursor ions of the selected mass 42 are deflected and exit the selection apparatus 220 parallel to the plates 219 and 221 through the space therebetween (e.g., the space defined between the first outer electrode plate 219 and the middle electrode plate 226) while the remainder of the secondary or precursor ions of other masses 41 which arrive earlier or later continue unaffected through the selection apparatus 220 (e.g., through the openings 262, 263 of the plates 221, 226, respectively) for analysis by the first mass spectrometer (MS1) (e.g., the TRIFT spectrometer including the detector 810).

For example, as shown in FIG. 11, a 1000 Da, 1000 eV ion would be deflected by 30 degrees with a 1000 volt, 359 ns pulse. The direction of the electric field and the resulting momentum impulse is perpendicular to the plates 219 and 221 and acts to slow as well as deflect selected precursor ions 11. For a 30 degree deflection, an ion exits with three quarters of its initial energy or 750 eV for the example represented in FIG. 11. A 45 degree selection would slow ions to one-half their initial energy.

Figure 7A:
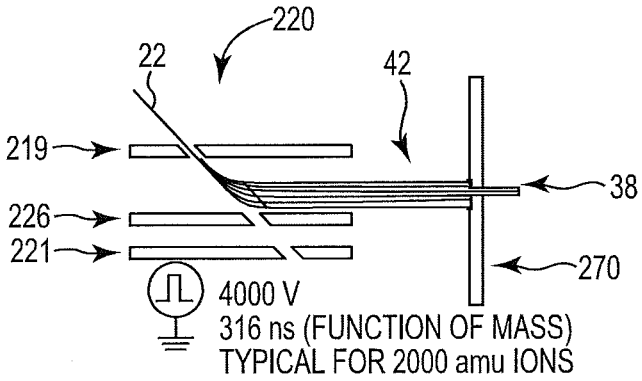
FIGS. 7A-7B are CAD drawings showing a side view and a perspective view of an exemplary selection apparatus along with typical ion trajectories.
Figure 7B:
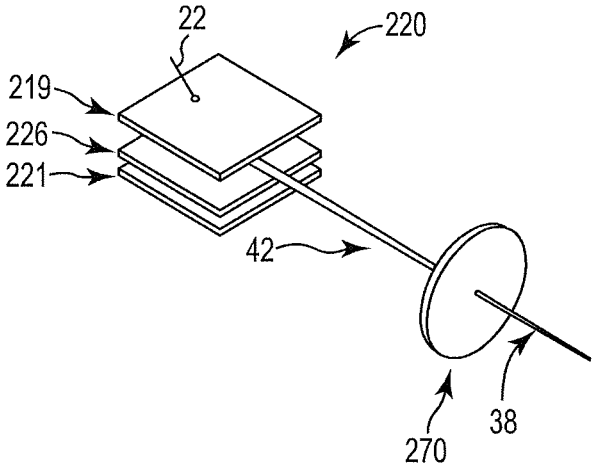

FIGS. 7A-7B are CAD drawings showing a side view and a perspective view of an exemplary selection apparatus such as shown in FIG. 11 as well as some ion trajectories. Such FIGS. 7A-7B illustrate trajectories which show that the precursor ions of the selected mass 41 are provided to an aperture of an activation device (e.g., a collision cell 270) downstream of the selection apparatus 220.

Figure 6A:
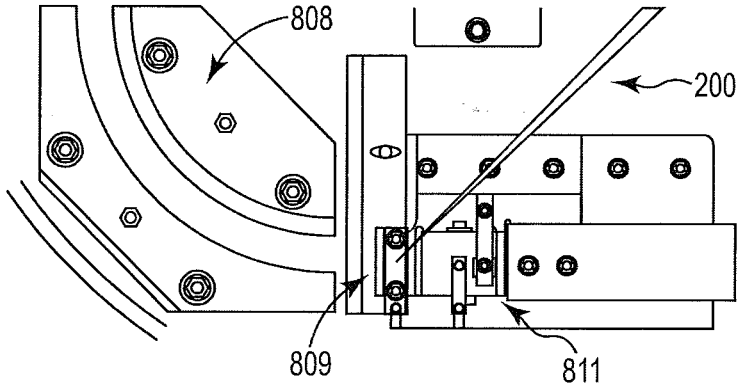
FIGS. 6A and 6B are enlarged sections of FIG. 5 showing exemplary changes required to pick selected precursor ion masses from a beam of ions and direct them into a second TOF mass spectrometer.
Figure 6B:
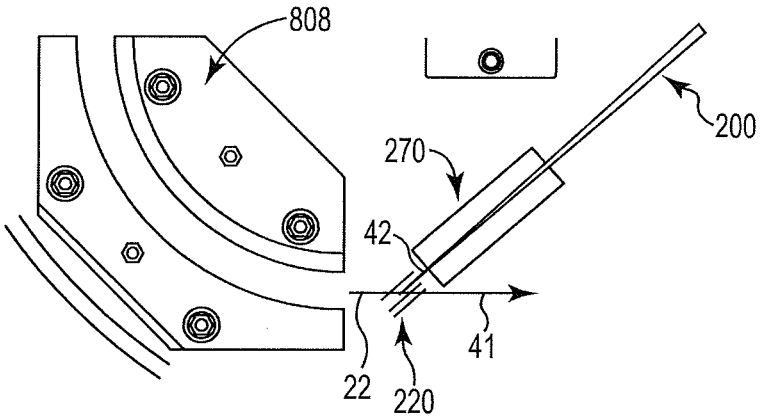

FIGS. 6A-6B zoom in on an exemplary location of the selection apparatus 220 shown in FIG. 5. FIG. 6A shows the MS2 beam path 200 overlaid on existing TRIFT optics while FIG. 6B shows a modification in which the post-ESA blanker 809 (see FIG. 1) may be replaced by the selection apparatus 220. Further, the detector quadrupole 811 (see FIG. 4), just downstream from the post-ESA blanker 809 in FIG. 6A, may be moved right (and is not shown) in FIG. 6B to make space for the selection apparatus 220 and a collision cell 270 (see, e.g., FIG. 10). The selection apparatus 220 may double as a post-ESA blanker for the tandem spectrometer described herein. The selection apparatus 220 may be positioned at a precursor ion beam trajectory angular crossover of the TRIFT TOF mass spectrometer beam so that the entire beam can pass through the smallest possible apertures in the selection apparatus 220 and collision cell 270.

Figure 8:
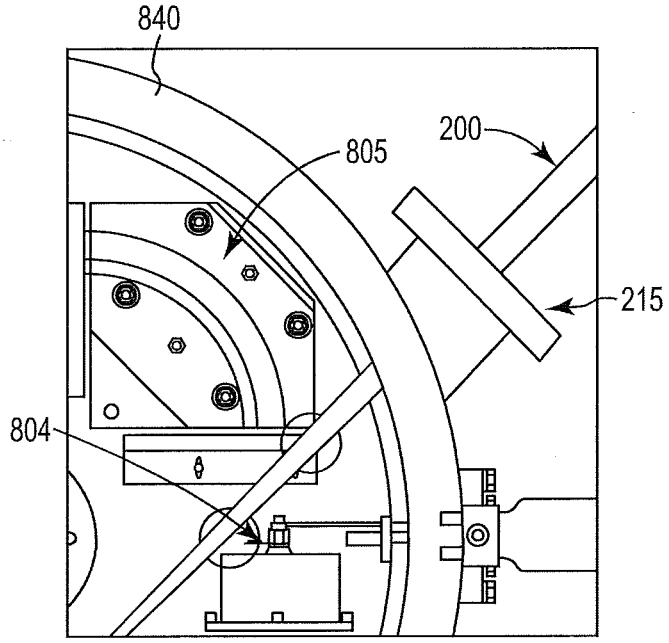
FIG. 8 is an enlarged section of FIG. 5 showing an exemplary route for the MS2 beam of precursor ions diverted by a selection apparatus to clear optics and exit the MS1 spectrometer chamber.

FIG. 8 is a detail view showing the region where the MS2 beam path 200 may cross the MS1 precursor ion beam path and may exit the vacuum chamber 840 of the TRIFT spectrometer 800. For example, with a suitable choice of selection apparatus, deflection angle, and appropriate TRIFT modifications (e.g. modified available apparatus from Physical Electronics USA (MN)), the beam paths may be made to cross in a region devoid of electric fields and physical obstructions.

Precursor ions 42 diverted by the selection apparatus 220 include those to be identified by fragmentation and further mass analysis in a second mass spectrometer (MS2) 190 (see, e.g., FIG. 5). For example, several types of mass spectrometers may be used for performing such functionality. For example, in one or more embodiments, the second mass spectrometer may be a linear TOF mass spectrometer design, a reflectron TOF mass spectrometer design, or an orthogonal TOF mass spectrometer design.

Figure 9:
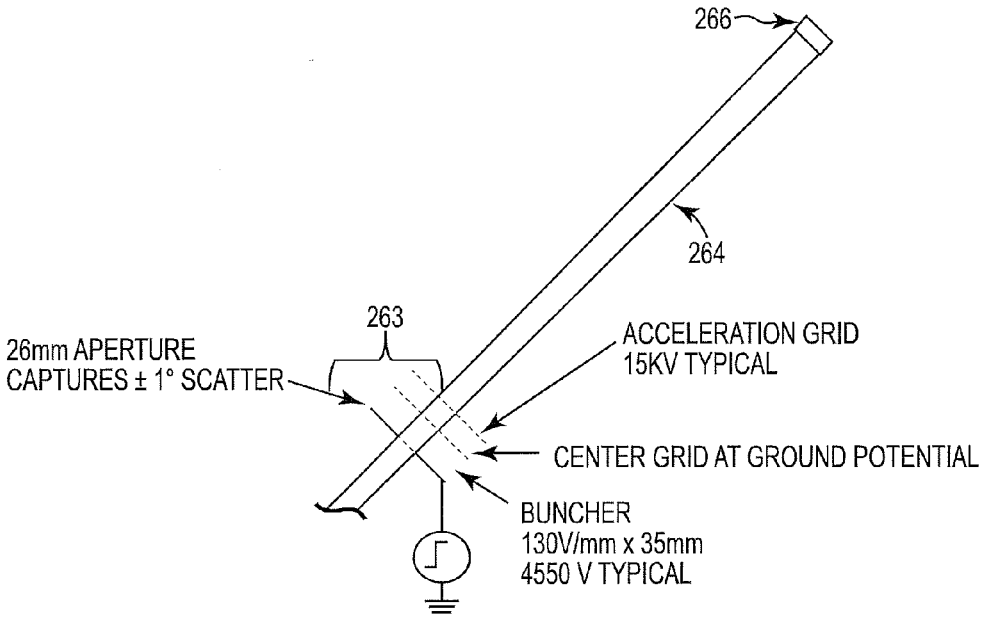
FIG. 9 is an enlarged section of FIG. 5 showing the MS2 beam and optics external to the MS1 spectrometer chamber.
Figure 10:
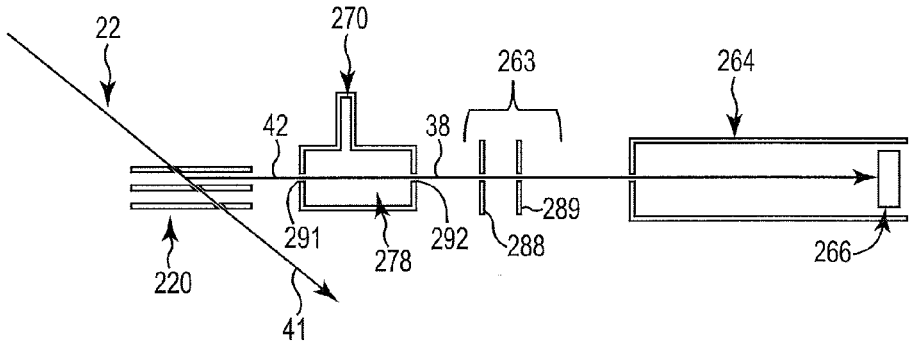
FIG. 10 is a schematic illustration showing an exemplary linear TOF implementation of MS2 optics.

In one embodiment, the second mass spectrometer MS2 190 may be a linear TOF mass spectrometer as shown in FIGS. 5 and 9-10. For example, such a linear design has been described by W. E. Stephens, "A Pulsed Mass Spectrometer with Time Dispersion," *Physical Review,* 1946 69, 691, which is incorporated herein by reference. For example, secondary ions in the precursor ion stream 22 of a selected mass may be deflected (e.g., by 45 degrees) by the selection apparatus 220 as shown in FIG. 10. For example, with a TRIFT beam energy of 3000 eV, the precursor ions may exit the selection apparatus with 1500 eV kinetic energy. Downstream (e.g., immediately downstream) from the selection apparatus 220, the deflected precursor ions 42 enter an activation apparatus (e.g., a collision cell 270). For example, the deflected precursor ions 42 enter an enclosed volume 278 of the collision cell 270 containing a collision gas, such as argon or krypton. For example, the collision cell 270 may be pressurized so that most deflected precursor ions 42 undergo a single collision to maximize the yield of fragment ions 38 without introducing excessive scatter due to multiple collisions. For example, in one or more embodiments, the entrance and exit apertures 291, 292 may restrict gas flow from the collision cell 270 to maintain a 1000-fold pressure differential between collision cell 270 (e.g., the activation apparatus) and components of the second mass spectrometer 190. For example, fragment ions 38 may exit the collision cell 270 with the velocity of their precursors minus small collision losses.

Thereafter, for example, bunching and acceleration apparatus 263 may be used to provide the necessary narrowing of the energy spread of the fragment ions and the necessary high kinetic energy to provide high mass resolution, high mass accuracy and high detection efficiency in the MS2. Any suitable bunching and acceleration apparatus may be used. FIG. 9 shows certain components of the second mass spectrometer 190 mounted external to a TRIFT spectrometer housing. Such components include the bunching and accelerating optics 263 for the fragment ions downstream from the collision cell 270 (not shown in FIG. 9). Downstream from the bunching and acceleration optics is a field-free drift space 264 followed by the mass spectrometer detector 266. The field-free drift space 264 functions to provide the m/z dependent time separation of the fragment ion species for the MS mass spectrometry.

In one or more embodiments, bunching and acceleration apparatus 263 may include two parallel grids forming a buncher as shown in FIG. 10. For example, the two parallel grids may be held at a constant potential, typically ground, until ions have entered the space between the grids (e.g., entered through one or more apertures in the grids). The first grid 288 of grids 288, 289 may be switched to a voltage that accelerates ions towards the detector. For example, the amount of acceleration depends on an ions position at switch time. Lagging ions, either because they are slower or because they started further from the detector, may be given a bigger push. Dimensions and voltages are chosen to minimize the effects of kinetic energy spread and variations in the fragment ion formation starting position so that total flight time depends mostly on mass.

Further, the bunching and acceleration apparatus 263 may include acceleration optics such as shown in FIG. 9 to further accelerate the fragment ions, for example, by another 10-15 kV, typically 14 kV. This acceleration may serve two purposes. First, fragment ions acquire velocities that depend on their masses so they will separate in the drift space 264 provided between the bunching and acceleration optics 263 and the mass spectrometer detector 266. Second, the fragment ions may acquire enough energy (e.g., by post-acceleration) that heavy ions are efficiently detected. The mass spectrometer detector 266 may be any of various known TOF detectors, such as a dual micro-channel plate/anode combination, electron multiplier/photomultiplier combination, simple electron multiplier, or any position sensitive detector technology, etc.

Experimental Results

Figure 12:
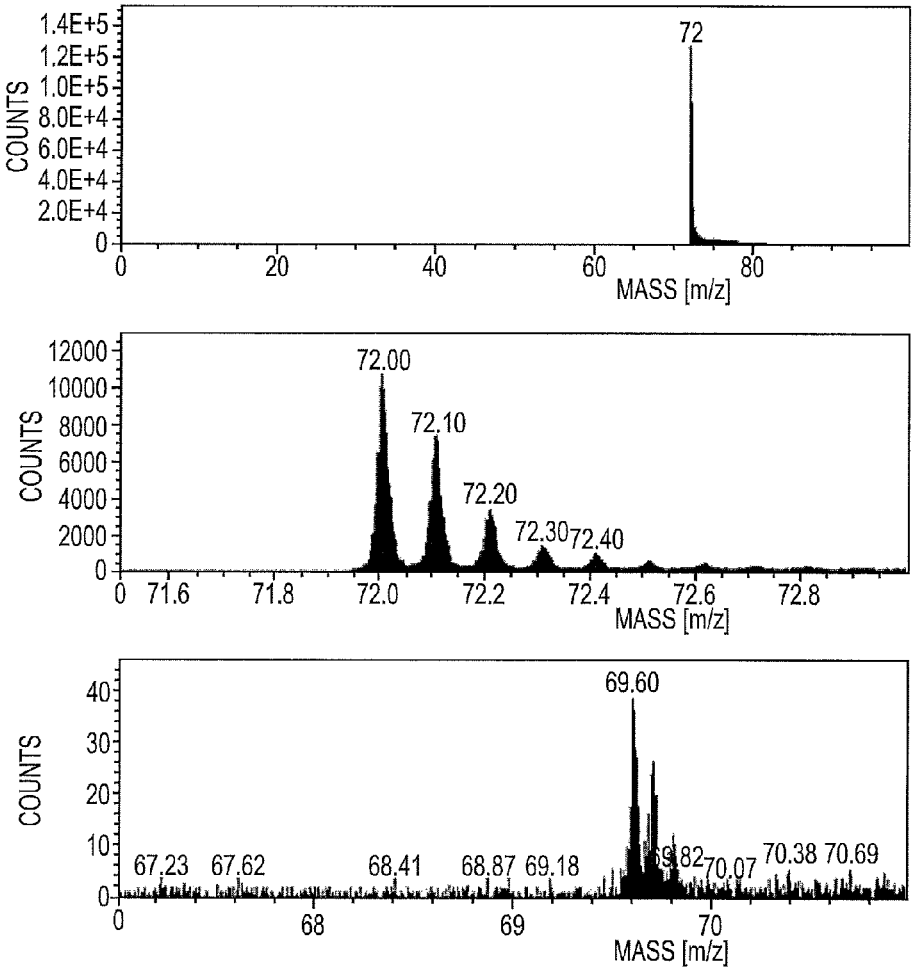
FIG. 12 is an illustrative mass spectrum of $C_{60}$ obtained with an exemplary prototype MS2 spectrometer without collision gas.

A prototype MS2 spectrometer was constructed and tested to demonstrate the feasibility of the MS2 design concept (see, FIG. 10), such as when used with MS1 (e.g., a TRIFT TOF mass spectrometer). A $C_{60}$ ion gun operated at 3 kV DC provided a source of precursor ions. FIG. 12 shows three views of a mass spectrum acquired without collision gas so the spectrum is representative of ion gun emission. Mass axis labels are one-tenth of true mass. The top panel of FIG. 12 shows a prominent peak at 720 Da, the nominal mass of $C_{60}$. The center panel expands the region around mass 720 Da to reveal additional peaks at 721, 722 Da, etc. The 720 peak is composed entirely of carbon-12 while heavier ions contain one or more carbon-13 atoms. The mass resolution of the spectrum is about 3400. The third panel expands the region around mass 696, indicating the ion beam is contaminated with about 0.3% $C_{58}$.

Figure 13:
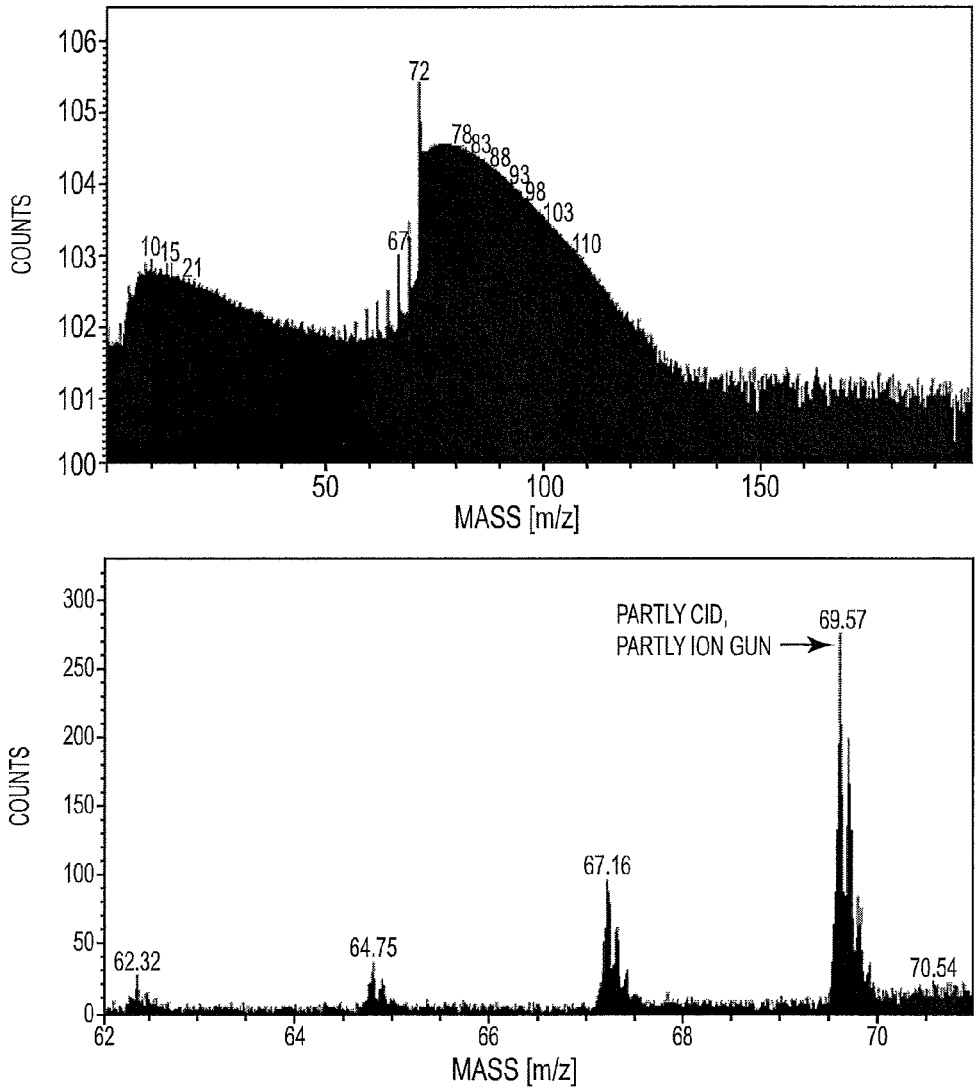
FIG. 13 is an illustrative mass spectrum of $C_{60}$ obtained with an exemplary prototype MS2 spectrometer with krypton collision gas.

FIG. 13 shows two views of a mass spectrum with 3 kV $C_{60}$ precursor ions acquired with krypton in the collision cell. The top panel shows the entire spectrum on a logarithmic scale. The 720 mass peak is most intense and an evenly-spaced series of lower mass fragment ions has appeared. The bottom panel provides a closer look at the fragment ions on a linear scale. Peaks at 696, 672, 648, and 624 Da correspond to the series $C_{58}$, $C_{56}$, $C_{54}$, and $C_{52}$, entirely consistent with the known fragmentation pattern of $C_{60}$. A greater yield of fragment ions is expected for typical organic samples because $C_{60}$ precursor ions are especially resistant to fragmentation.

In summary, the experimental results validate the design concept.

The complete disclosure of the patents, patent documents, and publications cited in the Background, the Summary, the Detailed Description of Exemplary Embodiments, and elsewhere herein are incorporated by reference in their entirety as if each were individually incorporated. Exemplary embodiments of the present invention are described above. Those skilled in the art will recognize that many embodiments are possible within the scope of the invention. Other variations, modifications, and combinations of the various components and methods described herein can certainly be made and still fall within the scope of the invention. Thus, the invention is limited only by the following claims and equivalents thereto.

What is claimed is:

1. A method for the acquisition of mass spectrometry data, the method comprising:

applying excitation pulses spatially to a sample resulting in a stream of charged particles, wherein each excitation pulse having a spatial position results in a corresponding portion of the stream of charged particles;

using a primary mass spectrometer to separate charged particles of the corresponding portion of the stream of charged particles resulting from each corresponding excitation pulse having a spatial position based on their mass-to-charge ratio and detecting the charged particles in a mass-to-charge spectrum;

diverting from each spatially resolved corresponding portion of the stream of charged particles a stream of precursor ions having a selected mass range for fragmentation to provide fragment ions, wherein the fragment ions are provided to a second mass spectrometer for analysis of the fragment ions during the same cycle time as the primary mass spectrometer is separating and detecting charged particles of the corresponding portion of the stream of charged particles based on their mass-to-charge ratio; and acquiring, by the primary mass spectrometer, at least one of spatially resolved mass spectrometry spectra, one or more spatially resolved mass spectrometry images, and one or more spatially resolved depth profiles.

2. The method of claim 1, wherein diverting from each spatially resolved corresponding portion of the stream of charged particles a stream of precursor ions comprises:

activating the diverted stream of precursor ions for the production of the fragment ions; and providing a mass spectrometry analysis of the mass-to-charge spectrum of a plurality of masses of the fragment ions.

3. The method of claim 1, wherein the primary mass spectrometer comprises a Time-of-Flight (TOF) mass spectrometer.

4. The method of claim 1, wherein the primary mass spectrometer acquires at least one of spatially resolved mass spectrometry spectra, spatially resolved mass spectrometry images, and spatially resolved depth profiles with the spatial resolution defined by the dimensions of an incident energetic probe on the sample surface.

5. The method of claim 1, wherein the primary mass spectrometer acquires at least one of spatially resolved mass spectrometry spectra, spatially resolved mass spectrometry images, and spatially resolved depth profiles with the spatial resolution defined by parallel microscope imaging of first spectrometer ion optics.

6. The method of claim 1, further comprising an excitation probe configured to provide the stream of charged particles comprises an ion beam or a laser beam.

7. The method of claim 6, wherein the excitation probe configured to provide the stream of charged particles comprises a focused ion beam or a focused laser beam.

8. The method of claim 1, wherein the primary mass spectrometer comprises a triple ion focusing time-of-flight (TRIFT) mass spectrometer.

9. The method of claim 1, wherein the second mass spectrometer comprises a linear TOF spectrometer, a reflectron TOF spectrometer, or an orthogonal TOF spectrometer.

10. The method of claim 1, further comprising an excitation probe configured to provide the stream of charged particles, wherein the excitation probe comprises an ion beam, wherein the ion beam comprises at least one of monatomic ion species, polyatomic cluster ion species, molecular ion species, and poly-molecular cluster ion species.

11. The method of claim 10, wherein the at least one of monatomic ion species, polyatomic cluster ion species, molecular ion species, and poly-molecular cluster ion species comprises at least one of $Ga^+$, $In^+$, $SF_5^+$, $C_{60}^+$, $C_{60}^{2+}$, $C_{70}^+$, $C_{70}^{2+}$, $C_{12}H_{24}^+$, $Au^+$, $Au_2^+$, $Au_3^+$, $Au_3^{2+}$, and $Bi_n^{q+}$ where n=1, 2, 3, 5, or 7 and q=1 or 2.

12. The method of claim 1, further comprising an excitation probe configured to provide the stream of charged particles, wherein the excitation probe comprises a gas cluster ion beam.

13. The method of claim 12, wherein the gas cluster ion beam comprises $Ar_n^+$ where n is an integer between 1 and 5,000.

14. The method of claim 1, wherein the method further comprises providing selection apparatus operable to select a mass range of precursor ions from the corresponding portions of the stream of charged particles corresponding to a selected percentage of the one or more pulses under computer control for parallel mass spectrometry/mass spectrometry analysis.

15. An apparatus for acquiring mass spectrometry data, the apparatus comprising:

a primary mass spectrometer configured to separate charged particles of a stream of charged particles based on their mass-to-charge ratio and detecting the charged particles in a mass-to-charge spectrum;

a selection apparatus configured to select a mass range of precursor ions from the stream of charged particles during the same cycle time as the primary mass spectrometer separates and detects charged particles based on their mass-to-charge ratio;

an activation apparatus configured to activate and fragment the selected precursor ions during the same cycle time as the primary mass spectrometer separates and detects charged particles based on their mass-to-charge ratio; and a second mass spectrometer configured for mass-to-charge analysis of a plurality of masses of the fragment ions provided from the activation apparatus during the same cycle time as the primary mass spectrometer separates and detects charged particles based on their mass-to-charge ratio.

16. The apparatus of claim 15, wherein the selection apparatus comprises an electrode plate structure, wherein the electrode plate structure comprises a center electrode plate spaced between at least two other electrode plates, wherein each electrode plate of the electrode plate structure comprises an aperture extending through the electrode plate, wherein the center electrode plate is configured to be electrically activated to extract selected mass-to-charge precursor ions from the stream of charged particles provided by the primary mass spectrometer and inject the selected precursor ions into the activation apparatus and the subsequent second mass spectrometer for mass spectroscopy/mass spectroscopy analysis.

17. The apparatus of claim 15, wherein the activation apparatus is configured to provide activation and fragmentation of the precursor ions by at least one of collision induced dissociation (CID) in a chamber containing a gas, electron beam induced dissociation, photon beam induced dissociation, and surface induced dissociation.

18. The apparatus of claim 4, wherein the stream of charged particles comprises portions thereof corresponding to each of one or more pulses of an excitation probe, and further wherein selection apparatus is operable to select a mass range of precursor ions from portions of the stream of charged particles corresponding to a selected percentage of the one or more pulses under computer control for parallel mass spectrometry/mass spectrometry analysis.

19. A method for the acquisition of mass spectrometry data, the method comprising:

applying excitation pulses spatially to a sample resulting in a stream of charged particles from an analytical volume, wherein each excitation pulse having a spatial position results in a corresponding portion of the stream of charged particles;

using, for each corresponding portion during a primary mass separation cycle, a primary mass spectrometer to separate charged particles of the corresponding portion of the stream of charged particles from the analytical volume based on their mass-to-charge ratio and detecting the charged particles in a mass-to-charge spectrum; and providing, for each corresponding portion during a primary mass separation cycle, fragment ions to a second mass spectrometer for analysis of the fragment ions, wherein the fragment ions are provided by fragmentation of selected particles from the resulting corresponding portion of the stream of charge particles from the analytical volume.

* * * * *